US009909600B2

(12) United States Patent
Yokota et al.

(10) Patent No.: US 9,909,600 B2
(45) Date of Patent: Mar. 6, 2018

(54) CYLINDER APPARATUS

(71) Applicant: KOSMEK LTD, Hyogo (JP)

(72) Inventors: Hideaki Yokota, Hyogo (JP); Keitaro Yonezawa, Hyogo (JP)

(73) Assignee: KOSMEK LTD., Hyogo (JP)

( * ) Notice: Subject to any disclaimer, the term of this patent is extended or adjusted under 35 U.S.C. 154(b) by 369 days.

(21) Appl. No.: 14/653,898

(22) PCT Filed: Jan. 16, 2014

(86) PCT No.: PCT/JP2014/050633

§ 371 (c)(1),
(2) Date: Jun. 19, 2015

(87) PCT Pub. No.: WO2014/115628

PCT Pub. Date: Jul. 31, 2014

(65) Prior Publication Data

US 2015/0345521 A1 Dec. 3, 2015

(30) Foreign Application Priority Data

Jan. 22, 2013 (JP) ..... 2013-022706
May 2, 2013 (JP) ..... 2013-108398

(51) Int. Cl.
*F15B 15/28* (2006.01)
*B23Q 3/08* (2006.01)
(Continued)

(52) U.S. Cl.
CPC ..... *F15B 15/2807* (2013.01); *B25B 5/062* (2013.01); *B25B 5/16* (2013.01); *F15B 15/1423* (2013.01)

(58) Field of Classification Search
CPC ..... F15B 15/2807; F15B 15/2892; F15B 15/1423; F15B 15/1433; F15B 2211/7653; B23Q 17/22; B25B 5/062; B25B 5/16
(Continued)

(56) References Cited

U.S. PATENT DOCUMENTS 3,661,053 A * 5/1972 Rich ..... F01L 25/08 200/332.1
2002/0134230 A1* 9/2002 Hirling ..... F15B 15/2892 92/5 R

FOREIGN PATENT DOCUMENTS

JP S5016385 U 2/1975
JP S60129410 A 7/1985
(Continued)

OTHER PUBLICATIONS

Chinese Office Action dated Jan. 20, 2017 issued in corresponding Chinese Patent Application No. 201380068239.6 and English translation thereof.
(Continued)

*Primary Examiner* — Thomas E Lazo
*Assistant Examiner* — Dustin T Nguyen
(74) *Attorney, Agent, or Firm* — Bacon & Thomas, PLLC

(57) ABSTRACT

A driving chamber (11) where pressurized fluid is supplied and discharged is arranged above a piston (10) inserted into a housing (1) ascendably and descendably. An ascent-detecting detection valve (32) is oriented laterally in an upper portion of the housing (1). An operating portion (10*b*) is provided on an upper portion of the piston (10), and an operated portion (79) movable in response to movement of the operating portion (10*b*) is provided on the detection valve (32). A transmission ball (70) is inserted into a transmission chamber (67) communicatively connected to an upper portion of the driving chamber (11). The transmission ball (70) converts ascent movement of the operating portion (10*b*) to lateral movement of the operated portion (79). Pressurized air for detection is supplied to an inlet (32*a*) of the detection valve (32) through a supply passage (B2).

14 Claims, 5 Drawing Sheets

(51) Int. Cl.

| | |
|---|---|
| ***B25B 5/00*** | (2006.01) |
| ***F15B 15/14*** | (2006.01) |
| ***B25B 5/06*** | (2006.01) |
| ***B25B 5/16*** | (2006.01) |

(58) Field of Classification Search
USPC ..... 92/5 R; 269/20, 24, 25
See application file for complete search history.

(56) References Cited

FOREIGN PATENT DOCUMENTS

| | | | |
|---|---|---|---|
| JP | H09257005 | A | 9/1997 |
| JP | H11292500 | A | 10/1999 |
| JP | 2004068875 | A | 3/2004 |
| WO | 2013051333 | A1 | 4/2013 |

OTHER PUBLICATIONS

Chinese Office Action dated Mar. 18, 2016 issued in corresponding Chinese Patent Application No. 201380068239.6 and English translation thereof.

* cited by examiner

CYLINDER APPARATUS

TECHNICAL FIELD

The present invention relates to a cylinder apparatus provided with a function of detecting a position to which a movable member such as a piston has been moved, and more particularly relates to a cylinder apparatus which is suitably applied to a work clamp.

BACKGROUND ART

As such a cylinder apparatus having the function of detection, conventionally, there is an apparatus described in Patent Literature 1 (Japanese Unexamined Patent Publication No. 129410/1985 (Tokukaishou 60-129410)).

FIG. 5 of the above known document illustrates a structure in which: a piston is inserted horizontally movably into a housing; a detection valve configured to check the position to which the piston has been moved with respect to a horizontal direction is arranged in each of right and left end walls of the housing; and a detection rod of each detection valve is operated by the piston.

CITATION LIST

Patent Literature

Patent Literature 1: Japanese Unexamined Patent Publication No. 129410/1985 (Tokukaishou 60-129410)

SUMMARY OF INVENTION

Technical Problem

In the above-described known art, the detection valve is arranged in each of the right and left end walls of the housing. Therefore, if the left end wall is attached to a stationary stand such as a table, it is difficult to access the left detection valve, and it is laborious to perform maintenance on the left detection valve.

Further, in the above-described known art, the detection rod of each detection valve is arranged in tandem with the piston, and therefore the degree of flexibility in arranging the detection valve is limited.

An object of the present invention is to provide a cylinder apparatus in which maintenance on a detection valve is easy.

Another object of the present invention is to provide a cylinder apparatus in which the degree of flexibility in arranging a detection valve is improved.

Solution to Problem

In order to achieve the above object, a cylinder apparatus of a first aspect of the invention is structured as follows, for example, as shown in FIG. 1A to FIG. 5B.

An annular piston 10 is inserted into a housing 1 ascendably and descendably. An output rod 15 is inserted into a cylindrical hole 10*a* of the piston 10 and is inserted into an upper wall 2 of the housing 1. Pressurized fluid for driving is supplied to and discharged from a driving chamber 11 arranged above the piston 10. The output rod 15 is configured to rotate in response to ascent and descent of the piston 10 relative to the output rod 15. Further, a descent-detecting first detection valve 31 and an ascent-detecting second detection valve 32 are arranged outside a periphery of the output rod 15 and in the upper wall 2, to be circumferentially spaced apart from each other at a predetermined interval. A first operated portion 49 and a second operated portion 79 are respectively provided on the first detection valve 31 and the second detection valve 32 in the vicinity of the driving chamber 11. The first operated portion 49 is arranged to be movable in response to movement of one of two members of the output rod 15 and the piston 10, while the second operated portion 79 is arranged to be movable in response to movement of the other of the two members. Pressurized air for detection is supplied to respective inlets 31*a* and 32*a* of the first detection valve 31 and the second detection valve 32 through a first supply passage B1 and a second supply passage B2, respectively.

The first aspect of the invention provides following functions and effects. Since the two detection valves which are the descent-detecting first detection valve and the ascent-detecting second detection valve are arranged outside the periphery of the output rod inserted into the upper wall of the housing, and in the upper wall, it is possible to access the two detection valves from upper right/left or from above even in the case where a lower wall of the housing is attached to a stationary stand such as a table, or in the case where a lower half portion of the housing is inserted into a mounting hole of such a stationary stand. Therefore, maintenance on the detection valves is not laborious.

Moreover, to install the two detection valves in the upper wall, an unused space in the upper wall can be used as an installation space for the valves, and this enables the cylinder apparatus to be kept compact in size.

Accordingly, there is provided the cylinder apparatus which is compact in size and in which maintenance on the detection valves is easy.

Further, to achieve the above object, a cylinder apparatus of a second aspect of the invention is structured as follows, for example, as shown in FIG. 3A and FIG. 3B.

A piston 10 is inserted into a housing 1 ascendably and descendably, and a driving chamber 11 where pressurized fluid for driving is supplied and discharged is arranged above the piston 10. An output rod 15 is inserted into an upper wall 2 of the housing 1, and the output rod 15 is configured to be descendingly driven by the pressurized fluid supplied to the driving chamber 11 via the piston 10. A descent-detecting first detection valve 31 and an ascent-detecting second detection valve 32 are arranged outside a periphery of the output rod 15 and in the upper wall 2, to be circumferentially spaced apart from each other at a predetermined interval. A first operated portion 49 and a second operated portion 79 are respectively provided on the first detection valve 31 and the second detection valve 32 in the vicinity of the driving chamber 11. The first operated portion 49 and the second operated portion 79 are arranged to be movable in response to movement of either one of the piston 10 and the output rod 15. Pressurized air for detection is supplied to respective inlets 31*a* and 32*a* of the first detection valve 31 and the second detection valve 32 through a first supply passage B1 and a second supply passage B2, respectively.

The second aspect of the invention provides following functions and effects.

Since the two detection valves which are the descent-detecting first detection valve and the ascent-detecting second detection valve are arranged outside the periphery of the output rod inserted into the upper wall of the housing, and in the upper wall, it is possible to access the two detection valves from upper right/left or from above even in the case where a lower wall of the housing is attached to a stationary stand such as a table, or in the case where a lower half portion of the housing is inserted into a mounting hole of such a stationary stand. Therefore, maintenance on the detection valves is not laborious.

Moreover, to install the two detection valves in the upper wall, an unused space in the upper wall can be used as an installation space for the valves, and this enables the cylinder apparatus to be kept compact in size.

Accordingly, there is provided the cylinder apparatus which is compact in size and in which maintenance on the detection valves is easy.

In each of the above aspects of the invention, it is preferable that: the upper wall 2 is formed into a substantially rectangular or square shape in plan view, and a supply and discharge passage 21 which is communicatively connected to the driving chamber 11 is formed in one wall portion out of four wall portions respectively corresponding to four peripheral sides of the upper wall 2; and the first detection valve 31 and the second detection valve 32 are provided in any other wall portion than the wall portion where the supply and discharge passage 21 is formed out of the four wall portions.

The above structure makes the cylinder apparatus more compact.

Further, in the above arrangement, it is preferable that: the upper wall 2 has a flange 7 for mounting; and a supply and discharge port P1 communicatively connected to the supply and discharge passage 21 is opened onto a mounting surface 7*a* formed on an under surface of an outer periphery portion of the flange 7.

The above structure achieves a simply structured system of supplying and discharging pressurized fluid for driving.

Furthermore, in the above arrangement, it is preferable that a first supply port A1 and a second supply port A2 communicatively connected to the first supply passage B1 and the second supply passage B2 respectively are opened, respectively below the first detection valve 31 and the second detection valve 32, onto the mounting surface 7*a*.

The above structure achieves a simply structured system of supplying pressurized air for detection.

Further, in the first aspect of the invention, it is preferable to structure the cylinder apparatus as follows.

Specifically, the output rod 15 includes a first operating portion 23*a*, and the first operating portion 23*a* is configured (i) to push the first operated portion 49 outward to open the first detection valve 31 when the output rod 15 moves from its lowered position to its upper limit position or to a position in the vicinity of the upper limit position, and (ii) to allow the first operated portion 49 to move inward to close the first detection valve 31 when the output rod 15 descends a predetermined first stroke 51 from the upper limit position. Meanwhile, the piston 10 includes a second operating portion 10*b*, and the second operating portion 10*b* is configured (i) to push the second operated portion 79 outward to close the second detection valve 32 when the piston 10 moves from its lowered position to its upper limit position or to a position in the vicinity of the upper limit position, and (ii) to allow the operated portion 79 to move inward to open the second detection valve 32 when the piston 10 descends a predetermined second stroke S2 from the upper limit position.

The above structure ensures that a lowered position and a raised position are detected separately from each other.

Furthermore, in the second aspect of the invention, the cylinder apparatus may be structured as follows.

One of the output rod 15 and the piston 10 includes a first operating portion 23*a* and a second operating portion 10*b*. The first operating portion 23*a* is configured to allow the first detection valve 31 to be closed when the one of the output rod 15 and the piston 10 descends a predetermined distance from its upper limit position or from a position in the vicinity of the upper limit position. Further, the second operating portion 10*b* is configured to close the second detection valve 32 via the second operated portion 79 when the one of the output rod 15 and the piston 10 ascends a predetermined distance from its lowered position.

Further, in each of the above arrangements, it is preferable to structure the cylinder apparatus as follows.

A first transmission member 40 configured to convert ascent movement of the first operating portion 23*a* to lateral movement is provided between the first operated portion 49 and the first operating portion 23*a*. Further, a second transmission member 70 configured to convert ascent movement of the second operating portion 10*b* to lateral movement is provided between the second operated portion 79 and the second operating portion 10*b*.

The above structure ensures that each operating portion operates the corresponding detection valve via the corresponding transmission member and the corresponding operated portion.

Further, in the above arrangement, it is preferable that: the first transmission member 40 and the second transmission member 70 each constituted by a ball are respectively inserted into a first transmission chamber 37 and a second transmission chamber 67 each of which is communicatively connected to an upper portion of the driving chamber 11; and stopper portions 37*a* and 67*a* are provided to prevent the first transmission member 40 and the second transmission member 70 from falling down into the driving chamber 11 from the first transmission chamber 37 and the second transmission chamber 67, respectively.

The above structure simplifies the system of holding each transmission member in the corresponding transmission chamber.

Further, in order to achieve the other object, a cylinder apparatus of a third aspect of the invention is structured as follows, for example, as shown in FIG. 1A to FIG. 5B.

The cylinder apparatus includes: an annular piston 10 inserted into a housing 1 ascendably and descendably; an output rod 15 which is inserted into a cylindrical hole 10*a* of the piston 10 and is inserted into an upper wall 2 of the housing 1; and a driving chamber 11 which is arranged above the piston 10 and where pressurized fluid for driving is supplied and discharged, the output rod 15 being configured to rotate in response to ascent and descent of the piston 10 relative to the output rod 15. The cylinder apparatus further includes: an ascent-detecting detection valve 32 oriented laterally in an upper portion of the housing 1; an operating portion 10*b* provided on one of the piston 10 and the output rod 15; an operated portion 79 provided on the detection valve 32 so as to be movable in response to movement of the operating portion 10*b* in the vicinity of the driving chamber 11; a transmission member 70 inserted into a transmission chamber 67 communicatively connected to an upper portion of the driving chamber 11, the transmission member 70 configured to convert ascent movement of the operating portion 10*b* to lateral movement of the operated portion 79; and a supply passage B2 through which pressurized air for detection is supplied to an inlet 32*a* of the detection valve 32.

In the third aspect of the invention, the ascent movement of the operating portion is converted to the lateral movement of the operated portion by the transmission member, and this makes it possible to orient the detection valve laterally, to improve the degree of flexibility in arranging the detection valve.

Furthermore, in order to achieve the other object, a cylinder apparatus of a fourth aspect of the invention is structured as follows, for example, as shown in FIG. 3A and FIG. 3B.

The cylinder apparatus includes: a piston 10 inserted into a housing 1 ascendably and descendably; a driving chamber 11 which is arranged above the piston 10 and where pressurized fluid for driving is supplied and discharged; and an output rod 15 inserted into an upper wall 2 of the housing 1. The output rod 15 is configured to be descendingly driven, via the piston 10, by the pressurized fluid supplied to the driving chamber 11. The cylinder apparatus further includes: an ascent-detecting detection valve 32 oriented laterally in an upper portion of the housing 1; an operating portion 10*b* provided on one of the piston 10 and the output rod 15; an operated portion 79 provided on the detection valve 32 so as to be movable in response to movement of the operating portion 10*b* in the vicinity of the driving chamber 11; a transmission member 70 inserted into a transmission chamber 67 communicatively connected to an upper portion of the driving chamber 11, the transmission member 70 configured to convert ascent movement of the operating portion 10*b* to lateral movement of the operated portion 79; and a supply passage B2 through which pressurized air for detection is supplied to an inlet 32*a* of the detection valve 32.

The above fourth aspect of the invention provides functions and effects similarly to those of the third aspect.

In the third or fourth aspect of the invention, it is preferable that a stopper portion 67*a* is provided to prevent the transmission member 70 constituted by a ball from falling down from the transmission chamber 67 into the driving chamber 11.

In the above-described aspects of the invention, it is preferable that each on-off valve such as the first detection valve and the second detection valve (or the detection valve) is constituted by either a poppet valve or a spool valve.

BRIEF DESCRIPTION OF THE DRAWINGS

FIG. 1A is an elevational view of the clamp in an unclamping state, corresponding to a section taken along a line 1A-1A of FIG. 2A.

REFERENCE SIGNS LIST

Figure 1C:
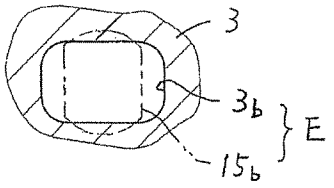
FIG. 1C illustrates a section taken along a line 1C-1C of FIG. 1B.

1: housing, 2: upper wall, 7: flange, 7*a*: mounting surface, 10: piston, 10*a*: cylindrical hole, 10*b*: second operating portion (operating portion), 11: driving chamber (first driving chamber), 15: output rod, 21: supply and discharge passage (first supply and discharge passage), 23: flange, 23*a*: first operating portion, 31: first detection valve, 31*a*: inlet, 32: second detection valve (detection valve), 32*a*: inlet, 37: first transmission chamber, 37*a*: stopper portion, 40: first transmission member, 49: first operated portion, 67: second transmission chamber (transmission chamber), 67*a*: stopper portion, 70: second transmission member (transmission member), 79: second operated portion (operated portion), B1: first supply passage, B2: second supply passage (supply passage), P1: supply and discharge port (first supply and discharge port), S1: first stroke, S2: second stroke

DESCRIPTION OF EMBODIMENTS

The following will describe one embodiment of the present invention with reference to FIG. 1A to FIG. 5B.

This embodiment deals with a case, as an example, where a cylinder apparatus is applied to a horizontal swing clamp for clamping a workpiece. First, the overall structure of the clamp will be described mainly with reference to FIG. 1A to FIG. 2C.

A housing 1 is mounted onto a table T functioning as a stationary stand. The housing 1 includes: an upper wall 2 functioning as one end wall; a lower wall 3 functioning as the other end wall; a cylindrical wall 4 extending vertically; and a cylinder hole 5 formed inside the cylindrical wall 4 and inside the upper wall 2. The upper wall 2 has, on its outer periphery portion, a flange 7 for mounting, and the upper wall 2 is formed into a substantially rectangular shape in plan view. Bolt holes 8 are vertically bored through four corners of the flange 7, respectively. Via fastening bolts (not illustrated) respectively inserted into the bolt holes 8, a mounting surface 7*a* formed on an under surface of the flange 7 is fixed to a top surface of the table T.

Into the cylinder hole 5, an annular piston 10 is hermetically inserted ascendably and descendably. Above and below the piston 10, a first driving chamber 11 for clamping and a second driving chamber 12 for unclamping are arranged, respectively.

Further, a first supply and discharge passage 21 communicatively connected to the first driving chamber 11 and a second supply and discharge passage 22 communicatively connected to the second driving chamber 12 are formed in a left wall portion, in plan view, out of four wall portions of the upper wall 2 respectively corresponding to four peripheral sides of the upper wall 2.

Furthermore, in the above-described left wall portion of the upper wall 2, a first supply and discharge port P1 communicatively connected to the first supply and discharge passage 21 and a second supply and discharge port P2 communicatively connected to the second supply and discharge passage 22 are opened onto the mounting surface 7*a*. Pressurized oil (pressurized fluid for driving) is supplied to and discharged from the first driving chamber 11 and the second driving chamber 12 through the first supply and discharge port P1 and the second supply and discharge port P2, respectively, and through the first supply and discharge passage 21 and the second supply and discharge passage 22, respectively.

An output rod 15 is inserted into a through hole 14 provided in a central portion of the upper wall 2 and into a cylindrical hole 10*a* of the piston 10. To an upper portion of the output rod 15, a clamp arm 16 is fixed with a nut 17. A sealing member 18 and a scraper 19 are installed outside the periphery of the output rod 15 and in the upper wall 2. In addition, a flange 23 provided on a midway portion of the output rod 15 is configured to be rotatably received by an under surface of the upper wall 2.

The cylinder hole 5 includes: a smaller diameter hole 5*a* which is an upper half portion; and a larger diameter hole 5*b* which is a lower half portion. The piston 10 is hermetically inserted into an annular space between the cylinder hole 5 and the output rod 15 via an outer sealing member 24 and an inner sealing member 25 so as to be movable in an axial direction (in this embodiment, in a vertical direction) and to be rotatable about the axis.

On an outer periphery portion of the piston 10, three guide grooves 26 are formed to be circumferentially spaced apart from one another at substantially equal intervals. Further, in each guide groove 26, an engaging ball (engaging member) 27 is fitted, which is held in a corresponding recessed hole 28 formed on a lower portion of an inner peripheral wall of the smaller diameter hole 5*a*. Each guide groove 26 is formed of a spiral rotational groove 26*b* and an advance groove 26*a* provided above the rotational groove 26*b* with continuity (see FIG. 3A).

Between the output rod 15 and the piston 10, a transmission mechanism 29 is provided. The transmission mechanism 29 is arranged to prevent rotation of the output rod 15 and the piston 10 relative to each other about the axis, and to allow movement of the output rod 15 and the piston 10 relative to each other in the axial direction. In this embodiment, the transmission mechanism 29 is structured as follows.

Figure 3C:
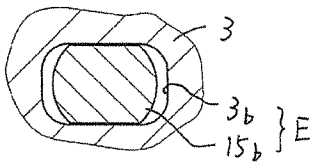
FIG. 3C illustrates a section taken along a line 3C-3C of FIG. 3B.
Figure 3B:
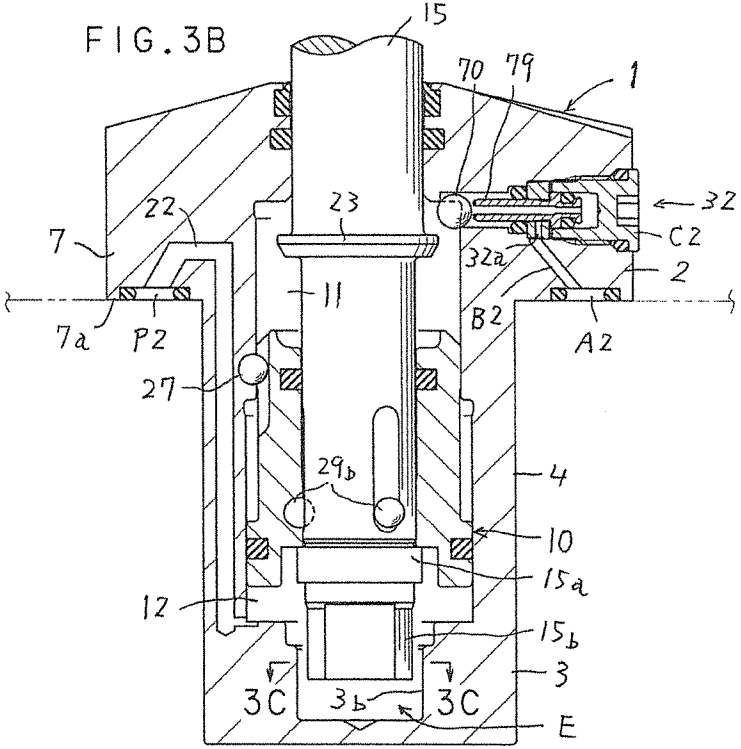
FIG. 3B also illustrates the clamp in the clamping state, and is a view similar to FIG. 1B.
Figure 3A:
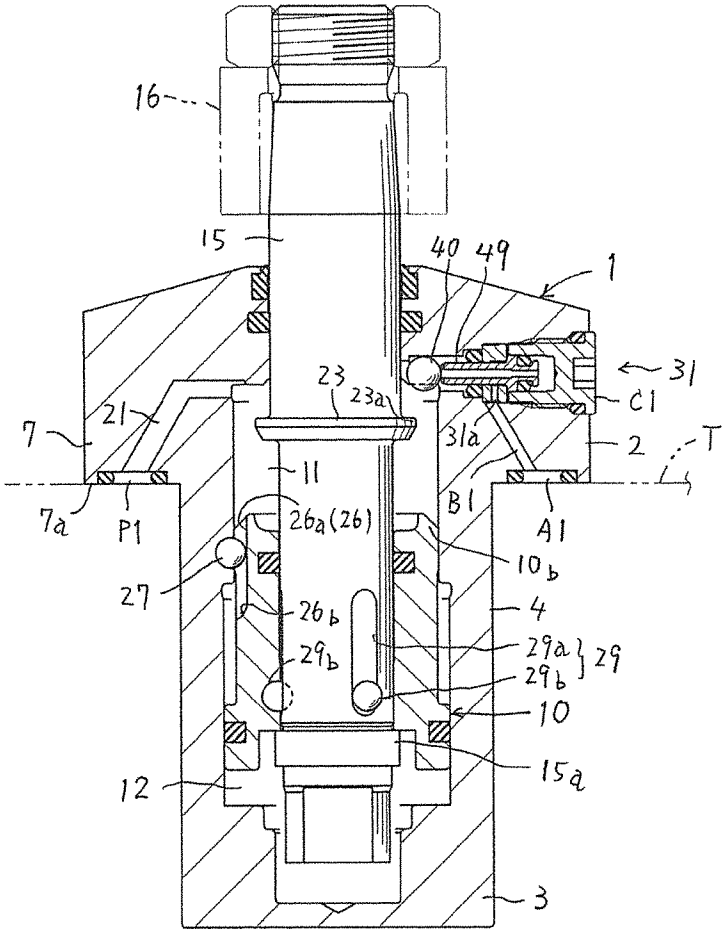
FIG. 3A illustrates the clamp in a clamping state, and is a view similar to FIG. 1A.

As shown in FIG. 3A and FIG. 3B, on an outer periphery portion of a middle-lower portion of the output rod 15, three transmission grooves 29*a* each extending vertically are formed to be circumferentially spaced apart from one another at substantially equal intervals. The piston 10 is provided with transmission balls 29*b* each fitted in the corresponding transmission groove 29*a*. In addition, the middle-lower portion of the output rod 15 is provided with a driven portion 15*a* which faces a lower portion of the piston 10.

The diameter of a part of the output rod 15 which is sealed by the sealing member 18 within the upper wall 2 is set to be larger than the diameter of a part of the output rod 15 which is sealed by the inner sealing member 25 within the piston 10. On this account, the pressure-receiving sectional area of a middle-upper portion of the output rod 15 is larger than the pressure-receiving sectional area of the middle-lower portion of the output rod 15, and thus the output rod 15 is raised to an unclamping raised position shown in FIG. 1A and FIG. 1B by a vertical differential force exerted thereon by the pressurized oil in the first driving chamber 11. Specifically, this embodiment deals with a mechanism in which the output rod 15 is kept in the unclamping raised position by the upward differential force exerted onto the output rod 15.

Further, the annular pressure-receiving sectional area of the piston 10 is set so that a downward force exerted on to the piston 10 is larger than the upward differential force exerted onto the output rod 15.

There is provided an erroneous operation prevention mechanism E configured to prevent the output rod 15 from descending during its rotation in the unclamping raised position, and to allow the output rod 15 to descend during its straight descent, which will be described later. The erroneous operation prevention mechanism E is structured as follows.

In the lower wall 3 of the housing 1, an accommodation hole 3*a* formed into a circular shape in plan view and a fitting hole 3*b* formed into an oval shape are provided vertically. The output rod 15 is provided with, at its lower end portion, a fitting portion 15*b* formed into an oval shape in plan view so as to correspond to the fitting hole 3*b*. In the unclamping state of FIG. 1A and FIG. 1B, the longitudinal axis of the fitting hole 3*b* is orthogonal to the longitudinal axis of the fitting portion 15*b* (see FIG. 1C). Further, in the unclamping state of FIG. 1A and FIG. 1B, a small gap G is formed between an under surface of the fitting portion 15*b* and a top surface of a peripheral wall of the fitting hole 3*b*.

If the output rod 15 descends, for some reason, during its rotation in the unclamping raised position, the under surface of the fitting portion 15*b* is received by the peripheral wall of the fitting hole 3*b*, and thereby the descent of the output rod 15 is stopped. On the contrary, during the later-described straight descent of the output rod 15, the fitting portion 15*b* is adapted to be fitted into the fitting hole 3*b* (see FIG. 3B and FIG. 3C which will be described later).

In a right wall portion, in plan view, out of the four wall portions of the upper wall 2, a descent-detecting first detection valve 31 and an ascent-detecting second detection valve 32 are provided outside the periphery of the output rod 15 to be circumferentially spaced apart from each other at a predetermined interval. Each of the axes of the first detection valve 31 and the second detection valve 32 is oriented substantially horizontally; however, each axis may be inclined so as to become closer to the axis of the piston 10 downwardly.

Further, in the right wall portion, a first supply port A1 and a second supply port A2 are opened onto the mounting surface 7*a* for supply of pressurized air for detection. The first supply port A1 and the second supply port A2 are communicatively connected to respective inlets 31*a* and 32*a* of the first detection valve 31 and the second detection valve 32, respectively, via the first supply passage B1 and the second supply passage B2, respectively.

The following will describe, in detail, the first detection valve 31 and the second detection valve 32.

Figure 4B:
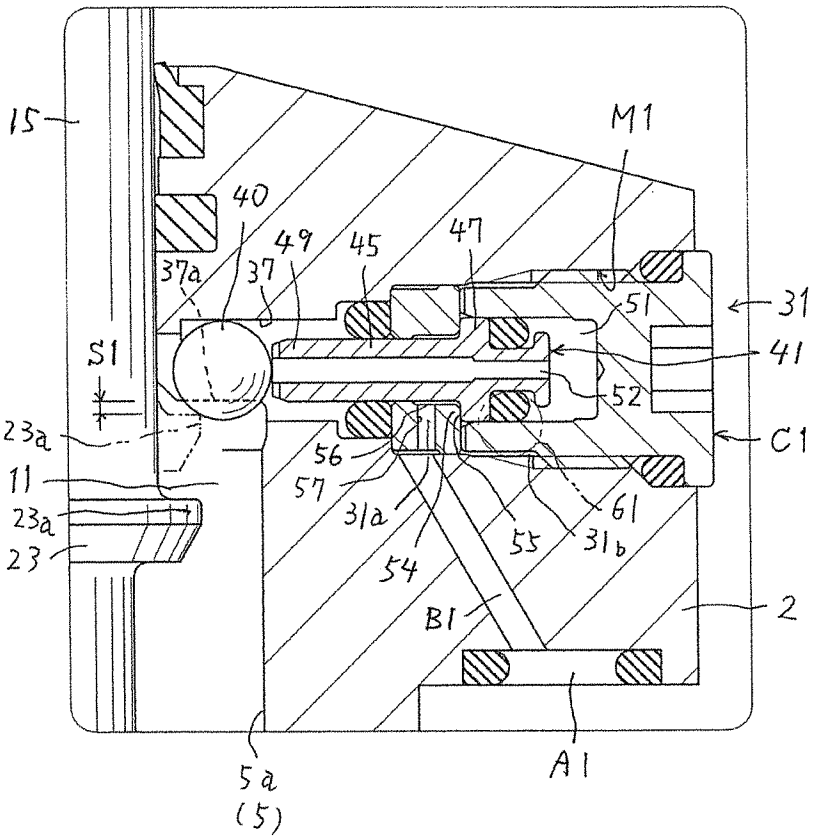
FIG. 4B is a partial enlarged view of FIG. 3A, illustrating the first detection valve in the clamping state.
Figure 4A:
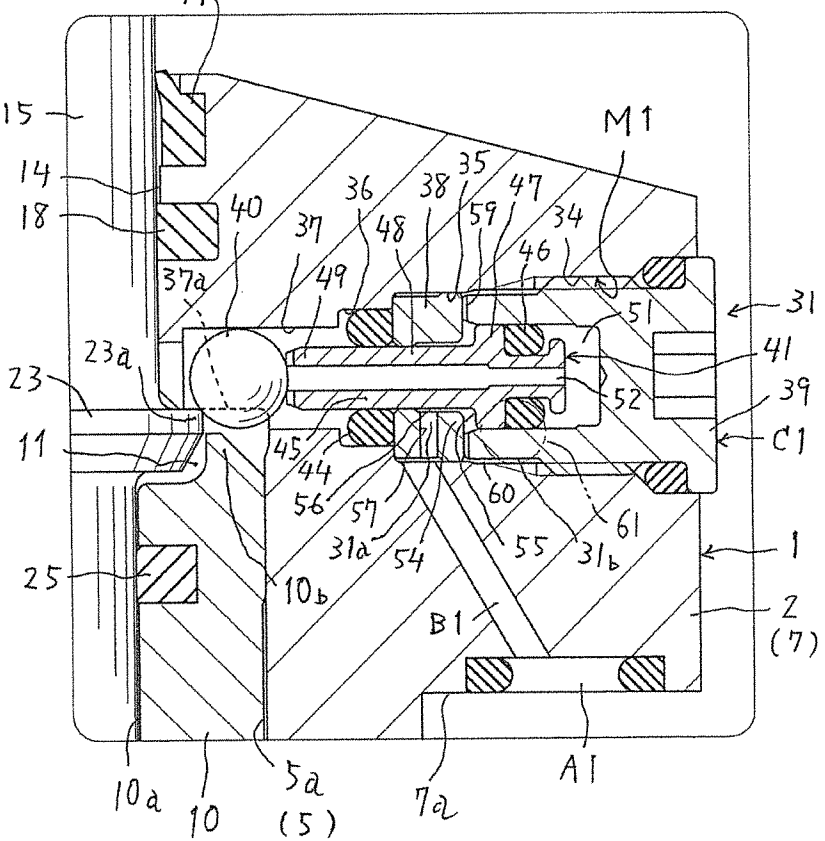
FIG. 4A is a partial enlarged view of FIG. 1A, illustrating a descent-detecting first detection valve in the unclamping state.

First, the descent-detecting first detection valve 31 will be described, mainly with reference to FIG. 4A and FIG. 4B. FIG. 4A is a partial enlarged view of FIG. 1A. FIG. 4B is a partial enlarged view of FIG. 3A.

The descent-detecting first detection valve 31 is opened by a first operating portion 23*a* provided on the flange 23 in the course of movement of the output rod 15 from its lowered position in FIG. 4B to its upper limit position in FIG. 4A (FIG. 4A illustrates the first detection valve 31 which has already been fully opened). Meanwhile, the first detection valve 31 is closed when the output rod 15 descends a predetermined first stroke S1 from the upper limit position in FIG. 4A. To be more specific, the first detection valve 31 is structured as follows, as shown in FIG. 4A and FIG. 4B.

Through the upper wall 2, a stepped first installation hole M1 is bored substantially horizontally. The first installation hole M1 includes: an internal threaded hole 34; a larger diameter hole 35; a medium diameter hole 36; and a smaller-diameter first transmission chamber 37, which are communicatively connected to one another in this order from a radially outer side to a radially inner side. A first casing C1 mounted in the first installation hole M1 includes: a valve barrel 38 installed in a left portion of the larger diameter hole 35; and a pressing barrel 39 screwed into the internal threaded hole 34. The pressing barrel 39 presses the valve barrel 38 onto the bottom of the larger diameter hole 35.

In the first transmission chamber 37, a first transmission member 40 constituted by a ball is inserted horizontally movably.

Into the first casing C1, a first detection rod 41 is inserted. The first detection rod 41 includes: a smaller-diameter inner pressure receiving portion 45 hermetically inserted into the medium diameter hole 36 via an inner sealing member 44; a larger-diameter outer pressure receiving portion 47 hermetically inserted into a barrel hole of the pressing barrel 39 via an outer sealing member 46; and a connecting rod 48 provided between the inner pressure receiving portion 45 and the outer pressure receiving portion 47. The pressure receiving area of the outer pressure receiving portion 47 is set to be larger than the pressure receiving area of the inner pressure receiving portion 45.

At a left end portion of the inner pressure receiving portion 45, there is provided a first operated portion 49. To the right of the outer pressure receiving portion 47, a pressure chamber 51 is formed. The pressure chamber 51 is communicatively connected to the first driving chamber 11 via a through hole 52 which is formed along the axis of the first detection rod 41 and via the first transmission chamber 37. A stopper portion 37*a* provided on an inner peripheral wall of the first transmission chamber 37 prevents the first transmission member 40 inserted in the first transmission chamber 37 from falling down to the first driving chamber 11.

An annular valve seat 54 is formed around a right portion of a barrel hole of the valve barrel 38, while a poppet type valve surface 55 is formed on a left portion of the outer pressure receiving portion 47. As shown in FIG. 4B, the valve surface 55 is configured to come into contact with the valve seat 54 when the first detection rod 41 moves leftward. Further, an annular inlet passage 56 is formed between the barrel hole of the valve barrel 38 and an outer peripheral surface of the connecting rod 48. Furthermore, a vertical hole 57 is bored through a peripheral wall of the valve barrel 38, and an upper end portion of the vertical hole 57 forms the inlet 31*a* of the first detection valve 31. The inlet 31*a* is communicatively connected to the first supply port A1 via the first supply passage B1.

On a left end surface of the pressing barrel 39, a plurality of radial grooves 59 are formed to be circumferentially spaced apart from one another at predetermined intervals. Further, an annular passage 60 is formed between a left portion of an outer peripheral surface of the pressing barrel 39 and an inner peripheral surface of the larger diameter hole 35, and a midway portion of the annular passage 60 forms an outlet 31*b* of the first detection valve 31. As mainly shown in FIG. 2C, the outlet 31*b* is communicatively connected to the outside air via a check valve 62 provided to a discharge passage 61. The check valve 62 includes: a valve seat 62*a*; and a spring 62*c* which urges a ball 62*b* onto the valve seat 62*a*.

Figure 5B:
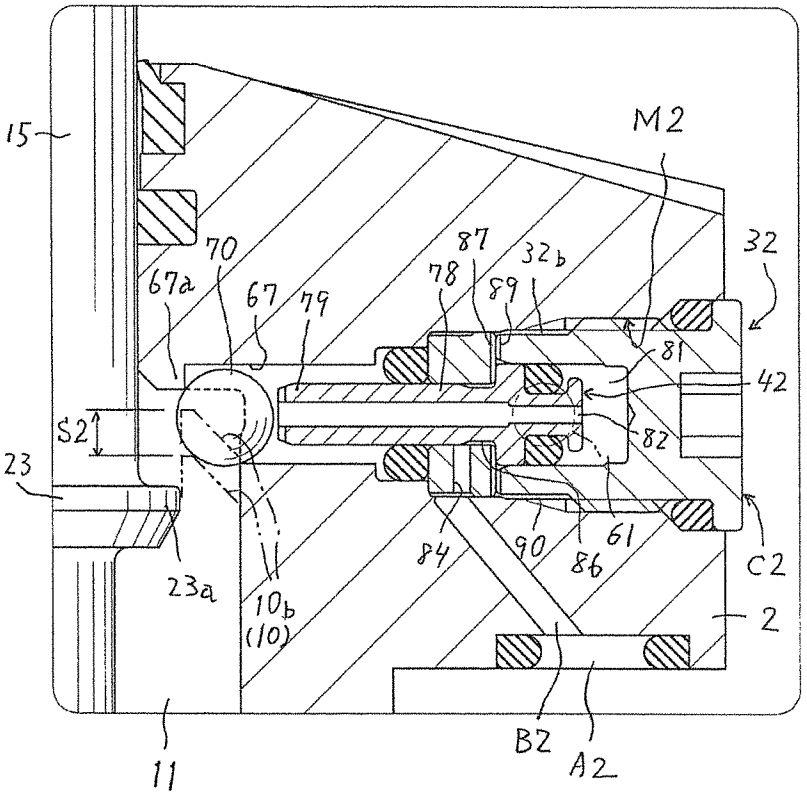
FIG. 5B is a partial enlarged view of FIG. 3B, illustrating the second detection valve in the clamping state.
Figure 5A:
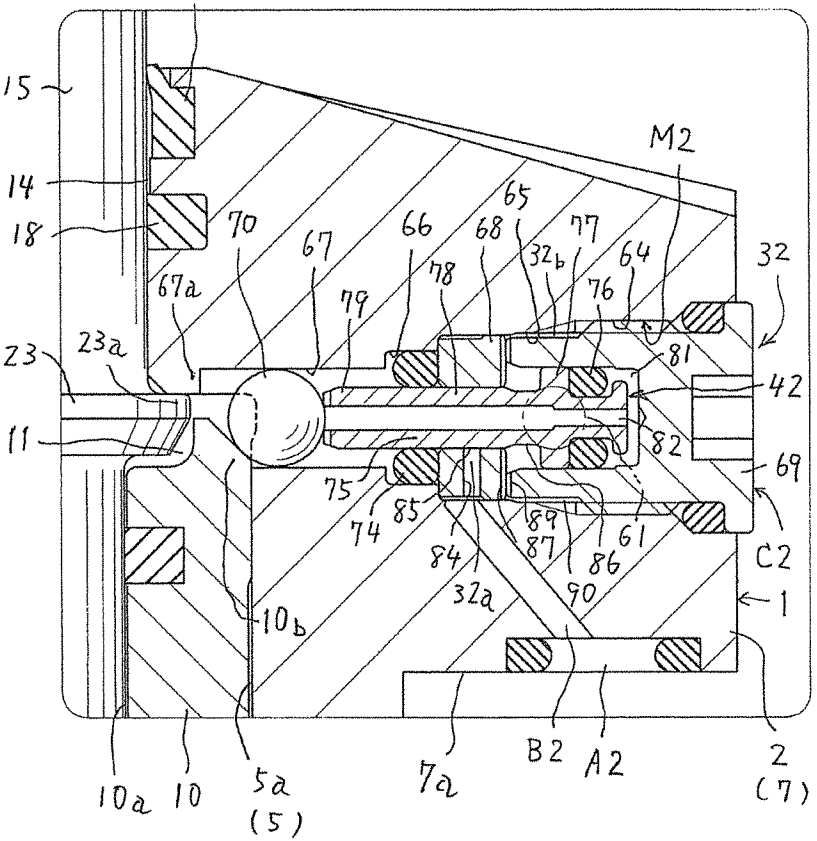
FIG. 5A is a partial enlarged view of FIG. 1B, illustrating an ascent-detecting second detection valve in the unclamping state.

The ascent-detecting second detection valve 32 is closed by the piston 10 when the piston 10 moves from its lowered position to its upper limit position in FIG. 5A or to a position in the vicinity of the upper limit position (FIG. 5A illustrates the second detection valve 32 which has already been fully closed). Meanwhile, the second detection valve 32 is opened when the piston 10 descends a predetermined second stroke S2 from the upper limit position in FIG. 5A (see an alternate long and short dash line figure and an alternate long and two short dashes line figure in FIG. 5B).

As shown in FIG. 5A and FIG. 5B, the second detection valve 32 is structured as follows, substantially similarly to the first detection valve 31.

Through the upper wall 2, a stepped second installation hole M2 is bored substantially horizontally. The second installation hole M2 includes: an internal threaded hole 64; a larger diameter hole 65; a medium diameter hole 66; and a smaller-diameter second transmission chamber 67, which are communicatively connected to one another in this order from the radially outer side to the radially inner side.

A second casing C2 mounted in the second installation hole M2 includes: a valve barrel 68 installed in a left portion of the larger diameter hole 65; and a pressing barrel 69 screwed into the internal threaded hole 64. The pressing barrel 69 presses the valve barrel 68 onto the bottom of the larger diameter hole 65.

In the second transmission chamber 67, a second transmission member 70 constituted by a ball is inserted horizontally movably.

Into the second casing C2, a second detection rod 42 is inserted. The second detection rod 42 includes: a smaller-diameter inner pressure receiving portion 75 hermetically inserted into the medium diameter hole 66 via an inner sealing member 74; a larger-diameter outer pressure receiving portion 77 hermetically inserted into a barrel hole of the pressing barrel 69 via an outer sealing member 76; and a connecting rod 78 provided between the inner pressure receiving portion 75 and the outer pressure receiving portion 77. The pressure receiving area of the outer pressure receiving portion 77 is set to be larger than the pressure receiving area of the inner pressure receiving portion 75.

At a left end portion of the inner pressure receiving portion 75, there is provided a second operated portion 79. To the right of the outer pressure receiving portion 77, a pressure chamber 81 is formed. The pressure chamber 81 is communicatively connected to the first driving chamber 11 via a through hole 82 formed along the axis of the second detection rod 42 and via the second transmission chamber 67. A stopper portion 67*a* provided on an inner peripheral wall of the second transmission chamber 67 prevents the second transmission member 70 inserted in the second transmission chamber 67 from falling down to the first driving chamber 11.

A valve hole 84 is vertically bored through a peripheral wall of the valve barrel 68, while a spool type valve surface 85 and an annular outlet groove 86 are formed, side by side, on an outer peripheral surface of the connecting rod 78. As shown in FIG. 5A, the valve surface 85 is configured to close the valve hole 84 when the second detection rod 42 moves rightward.

An upper end portion of the valve hole 84 forms an inlet 32*a* of the second detection valve 32. The inlet 32*a* is communicatively connected to the second supply port A2 via the second supply passage B2.

On a right end surface of the valve barrel 68, a plurality of radial grooves 87 are formed to be circumferentially spaced apart from one another at predetermined intervals. Further, on a left end surface of the pressing barrel 69, a plurality of radial grooves 89 are formed to be circumferentially spaced apart from one another at predetermined intervals. An annular passage 90 is formed between a left portion of an outer peripheral surface of the pressing barrel 69 and an inner peripheral surface of the larger diameter hole 65, and a midway portion of the annular passage 90 forms an outlet 32*b* of the second detection valve 32. The outlet 32*b* is communicatively connected to the outside air via the discharge passage 61 and the check valve 62 (see FIG. 2C).

The clamping apparatus having the above-described structure operates as follows.

Figure 1B:
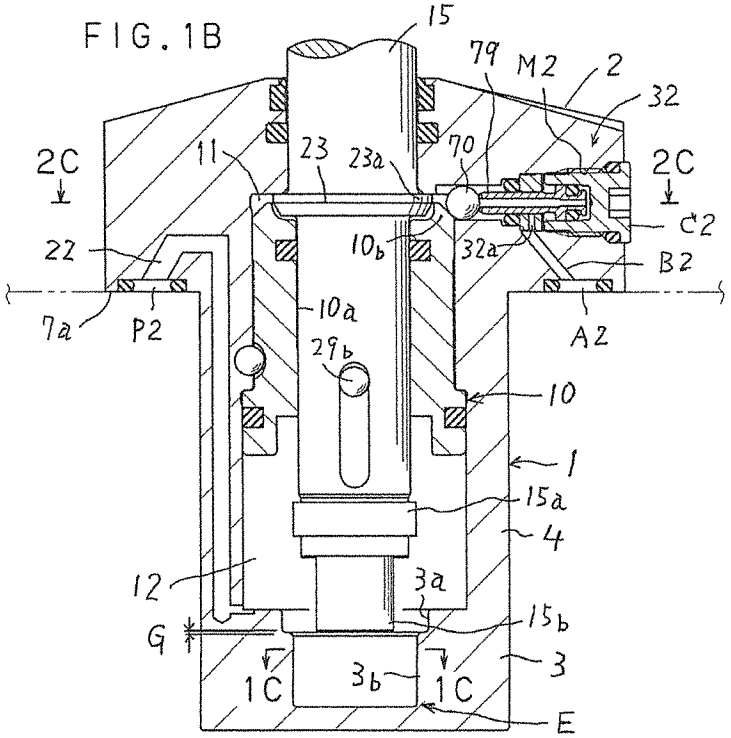
FIG. 1B is a view corresponding to a section taken along a line 1B-1B of FIG. 2A, and similar to FIG. 1A.
Figure 1A:
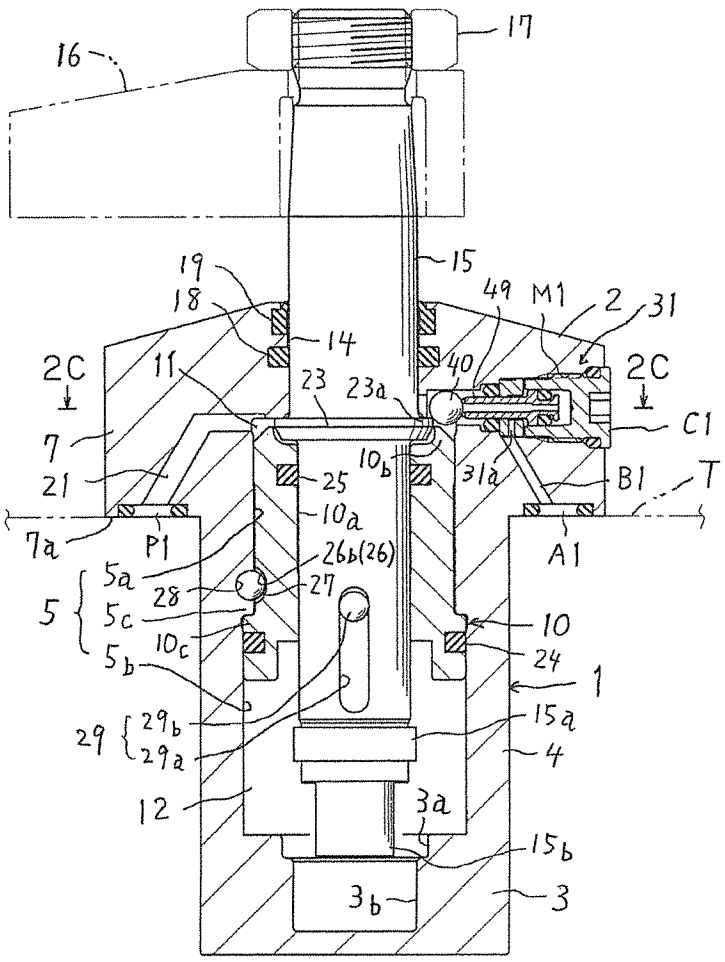
FIG. 1A illustrates a work clamp to which a cylinder apparatus of the present invention is applied.
Figure 2B:
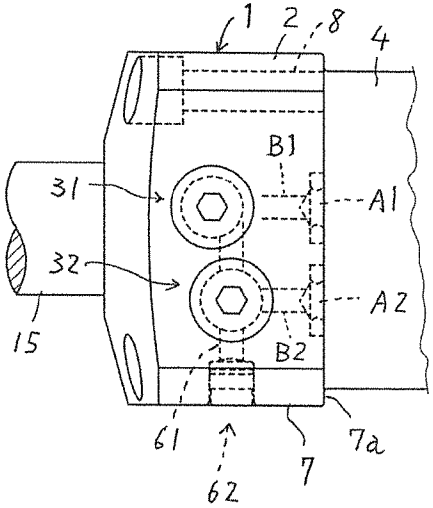
FIG. 2B is a right side view of the clamp of FIG. 2A.
Figure 2A:
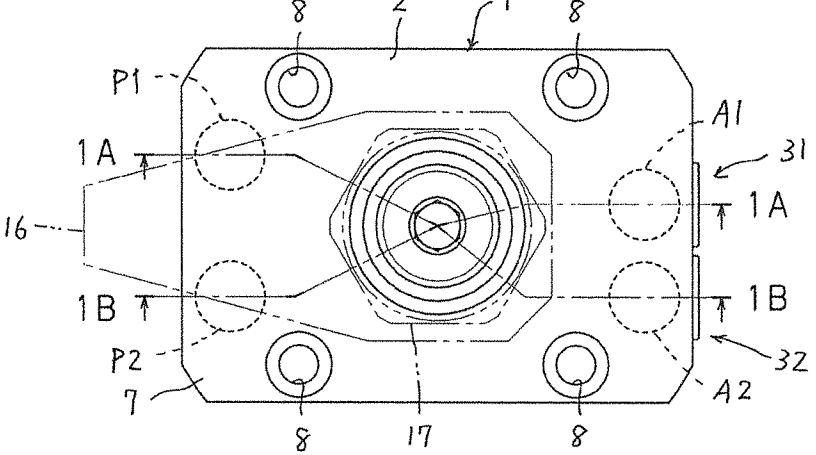
FIG. 2A is a plan view of the clamp of FIG. 1A.
Figure 2C:
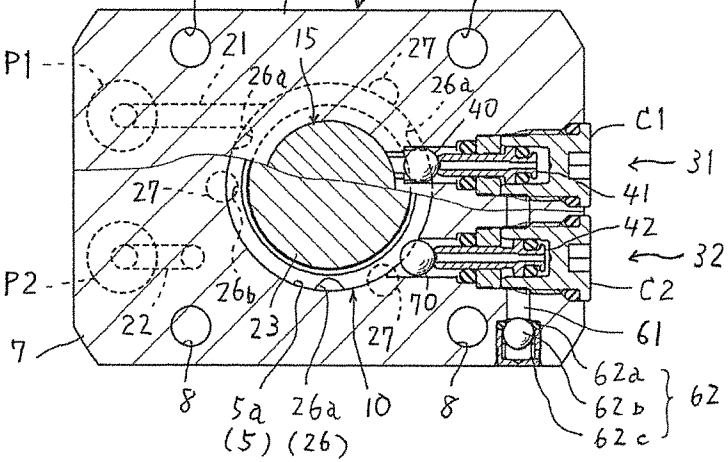
FIG. 2C is a view corresponding to a section taken along a line 2C-2C of FIG. 1A and corresponding to a section taken along taken along a line 2C-2C of FIG. 1B.

In the unclamping state in FIG. 1A to FIG. 1C, pressurized oil in the upper first driving chamber 11 is discharged, while pressurized oil is supplied to the lower second driving chamber 12. This raises the piston 10, so that a shoulder portion 10*c* of the piston 10 is received by a stepped portion 5*c* of the cylinder hole 5, and the piston 10 is raised to its upper limit position. Meanwhile, the output rod 15 is held at the unclamping raised position in FIG. 1A by an upward force exerted onto the pressure receiving area which corresponds to the sectional area sealed by the inner sealing member 25.

In the above unclamping state, the descent-detecting first detection valve 31 shown in FIG. 1A is opened. To be more specific, as shown in FIG. 4A, the first operating portion 23*a* provided on the flange 23 of the output rod 15 pushes the first detection rod 41 rightward via the first transmission member 40 and the first operated portion 49, and thereby the valve surface 55 of the outer pressure receiving portion 47 is separated from the valve seat 54. Therefore, pressurized air supplied to the first supply port A1 flows through the first supply passage B1, the inlet 31*a*, the annular inlet passage 56, the radial groove 59, and the outlet 31*b*, to the discharge passage 61, and then the pressurized air in the discharge passage 61 pushes the ball 62*b* of the check valve 62 to open the valve 62, to be discharged to the outside air (see FIG. 2C).

Further, in the above unclamping state, the ascent-detecting second detection valve 32 shown in FIG. 1B is closed. To be more specific, as shown in FIG. 5A, the second operating portion 10*b* of the piston 10 pushes the second detection rod 42 rightward via the second transmission member 70 and the second operated portion 79, and thereby the valve surface 85 of the connecting rod 78 closes the valve hole 84. Therefore, the pressure at the second supply port A2 increases to a setting value, and this increase in pressure is detected by a sensor, which shows that the clamp is in the unclamping state.

To change from the above unclamping state in FIG. 1A to FIG. 1C to a clamping state, under the above unclamping state, pressurized oil in the lower second driving chamber 12 is discharged through the second supply and discharge port P2 while pressurized oil at the first supply and discharge port P1 is supplied to the upper first driving chamber 11.

Then, due to the pressure in the first driving chamber 11, the piston 10 descends while rotating clockwise in plan view along the rotational grooves 26*b* of the guide grooves 26. With this, the output rod 15 (and the clamp arm 16) held at the unclamping raised position is horizontally rotated clockwise, in plan view, via the transmission balls 29*b* and the transmission grooves 29*a*.

Then, when the piston 10 descends a rotational stroke, the output rod 15 (and the clamp arm 16) rotates substantially 90 degrees and the lower portion of the piston 10 comes into contact with the driven portion 15*a*. Simultaneously, the phase of the fitting portion 15*b* provided at the lower end of the output rod 15 matches the phase of the fitting hole 3*b* (see FIG. 3C), and the fitting portion 15*b* faces the fitting hole 3*b*.

Subsequently, due to the pressure in the first driving chamber 11, the piston 10 descends straight down along the advance grooves 26*a* of the guide grooves 26, and therefore, as shown in FIG. 3A (and FIG. 3B), the piston 10 lowers the output rod 15 straight down via the driven portion 15*a*. As a result, the clamp arm 16 presses a workpiece onto an upper surface of the stationary stand (the workpiece and the stationary stand are not illustrated).

During the descent of the piston 10 and the output rod 15, the descent-detecting first detection valve 31 and the ascent-detecting second detection valve 32 operate as follows.

As pressurized oil supplied to the first driving chamber 11 lowers the piston 10 from the upper limit position in FIG. 5A, the pressurized oil in the first driving chamber 11 is supplied to the pressure chamber 81 through the through hole 82 of the second detection rod 42, and the pressurized oil in the pressure chamber 81 moves the second detection rod 42 leftward from its position in FIG. 5A.

Subsequently, as shown in the alternate long and two short dashes line figure in FIG. 5B, when the piston 10 descends the second stroke S2, the annular outlet groove 86 on the connecting rod 78 faces the valve hole 84, and thereby the second detection valve 32 is fully opened. Therefore, pressurized air supplied to the second supply port A2 flows, through the second supply passage B2, the valve hole 84, the outlet groove 86, the two radial grooves 87 and 89, and the annular passage 90, to the discharge passage 61. The pressurized air in the discharge passage 61 pushes the ball 62*b* of the check valve 62 to open the valve 62, to be discharged to the outside air (see FIG. 2C).

Further, during the above descent driving, pressurized oil supplied from the first driving chamber 11 to the pressure chamber 51 moves the first detection rod 41 leftward from its position in FIG. 4A. Subsequently, as shown in an alternate long and two short dashes line figure in FIG. 4B, when the output rod 15 descends the first stroke 51, the valve surface 55 of the outer pressure receiving portion 47 comes into contact with the valve seat 54, and thereby the first detection valve 31 is fully closed. Therefore, pressure of the pressurized air at the first supply port A1 increases to a setting value, and this increase in pressure is detected by a sensor, which shows that the clamp is transitioning to the clamping state.

To change from the clamping state in FIG. 3A to FIG. 3C to the unclamping state in FIG. 1A to FIG. 1C, under the clamping state, pressurized oil in the upper first driving chamber 11 is discharged while pressurized oil is supplied to the lower second driving chamber 12. Then, the clamping apparatus operates through the reversed procedure of the above-described procedure.

Specifically, first, the piston 10 and the output rod 15 are raised straight up by a hydraulic force in the second driving chamber 12, and the flange 23 of the output rod 15 is received by the upper wall 2. Then, as shown in FIG. 1A, the piston 10 ascending while rotating rotates the output rod 15 counterclockwise in plan view.

During the ascent of the piston 10 and the output rod 15, the descent-detecting first detection valve 31 and the ascent-detecting second detection valve 32 operate as follows.

As pressurized oil supplied to the second driving chamber 12 raises the piston 10 and the output rod 15 from their lowered positions, first, as shown in the alternate long and two short dashes line figure in FIG. 4B, the first operating portion 23*a* provided on the flange 23 of the output rod 15 comes into contact with the first transmission member 40. Subsequently, as shown in FIG. 4A, the first operating portion 23*a* moves the first detection rod 41 rightward via the first transmission member 40 and the first operated portion 49 of the first detection valve 31, thereby to separate the valve surface 55 from the valve seat 54. As a result, the first detection valve 31 is fully opened, and pressurized air at the first supply port A1 is discharged to the outside air, so that the pressure at the first supply port A1 decreases.

Further, during the ascent of the piston 10, as shown in the alternate long and two short dashes line figure in FIG. 5B, first, the second operating portion 10*b* of the piston 10 comes into contact with the second transmission member 70. Subsequently, as shown in FIG. 5A, the second operating portion 10*b* moves the second detection rod 42 rightward via the second transmission member 70 and the second operated portion 79 of the second detection valve 32, so that the valve surface 85 of the second detection rod 42 faces the valve hole 84. As a result, the second detection valve 32 is fully closed, and the pressure of the pressurized air at the second supply port A2 increases to the setting value. This increase in pressure is detected by the sensor, which shows that the clamp is in the unclamping state.

The above-described embodiment brings about following advantages.

Since the two detection valves which are the descent-detecting first detection valve 31 and the ascent-detecting second detection valve 32 are arranged outside the periphery of the output rod 15 inserted into the upper wall 2 of the housing 1, and in the upper wall 2, it is possible to access the two detection valves 31 and 32 from upper right/left or from above, even in the case where the lower wall 3 of the housing 1 is attached to a stationary stand such as a table, or in the case where a lower half portion of the housing 1 is inserted into a mounting hole of such a stationary stand. Therefore, maintenance on the detection valves 31 and 32 is not laborious.

Further, the first supply passage B1 and the second supply passage B2 through which pressurized air for detection is respectively supplied to the above two detection valves 31 and 32 are provided in the upper wall 2, and the first supply port A1 and the second supply port A2 are opened onto the mounting surface 7*a* of the flange 7 of the upper wall 2. This achieves a simply structured system for supplying pressurized air.

Moreover, to install the two detection valves 31 and 32 in the upper wall 2, an unused space in the upper wall 2 can be used as an installation space for the valves, and this enables the cylinder apparatus, which is a main component of the clamp, to be compact in size.

The above-described embodiment can be modified as follows.

The descent-detecting first detection valve 31 may be structured differently as long as: the first detection valve 31 is opened by the output rod 15 in the course of movement of the output rod 15 from its lowered position to its upper limit position; and the first detection valve 31 is closed when the output rod 15 descends the predetermined first stroke S1 from the upper limit position. Therefore, various cases are possible such as a case where the first detection valve 31 is fully closed when the output rod 15 descends from the upper limit position to a clamp stroke area (an area corresponding to the stroke area of the advance grooves 26*a*), and a case where the first detection valve 31 is fully closed when the output rod 15 descends from the upper limit position to a position in the vicinity of the clamp stroke area.

Meanwhile, the ascent-detecting second detection valve 32 may be structured differently as long as: the second detection valve 32 is closed by the piston 10 when the piston 10 moves from its lowered position to its upper limit position or to a position in the vicinity of the upper limit position; and the second detection valve 32 is opened when the piston 10 descends the predetermined second stroke S2 from the upper limit position. Therefore, instead of being fully closed at the upper limit position, the second detection valve 32 may be fully closed when the piston 10 ascends to a position in the vicinity of the upper limit position.

The first detection valve 31 and the second detection valve 32 may be oriented obliquely instead of being oriented horizontally.

Further, the above-described two detection valves 31 and 32 are arranged in the right wall portion, in plan view, out of the four wall portions corresponding to the four sides of the upper wall 2 of the housing 1; however, instead of this, the detection valves 31 and 32 may be provided in an upper or lower wall portion in plan view. The upper wall 2 may be formed into a substantially square shape, in plan view, instead of being formed into the substantially rectangular shape.

The valve structure of each of the detection valves 31 and 32 may be freely chosen between the poppet type and the spool type.

The first operating portion 23*a* configured to operate the first detection valve 31 may be provided on the piston 10, instead of being provided on the output rod 15. In addition, the second operating portion 10*b* configured to operate the second detection valve 32 may be provided on the output rod 15, instead of being provided on the piston 10.

Instead of the exemplarily-described configuration in which a mechanism for rotating the output rod 15 is provided between the housing 1 and the piston 10, such a mechanism may be provided between the piston 10 and the output rod 15. In this case, the piston 10 is configured to be axially movable relative to the housing 1 and non-rotatable about the axis relative to the housing 1.

The cylinder apparatus of the present invention is applicable, not only to the configuration in which the output rod 15 horizontally rotates in the raised position, but to a configuration in which the output rod 15 ascends/descends while rotating, or to a configuration in which the output rod 15 ascends/descends without rotating. In each of these other configurations, the detection valves 31 and 32 may be opened/closed as follows.

The first operating portion 23*a* and the second operating portion 10*b* are provided on either one of the output rod 15 and the piston 10. The first operating portion 23*a* is configured: to allow the descent-detecting first detection valve 31 to be closed when the one of the output rod 15 and the piston 10 descends a predetermined distance from its upper limit position or from a position in the vicinity of the upper limit position; and to open the first detection valve 31 via the first operated portion 49 when the one of the output rod 15 and the piston 10 ascends a predetermined distance from its lowered position. Further, the second operating portion 10*b* is configured: to close the ascent-detecting second detection valve 32 via the second operated portion 79 when the one of the output rod 15 and the piston 10 ascends a predetermined distance from the lowered position; and to allow the second detection valve 32 to be opened when the one of the output rod 15 and the piston 10 descends a predetermined distance from the upper limit position or from a position in the vicinity of the upper limit position.

Either one of the two detection valves 31 and 32 may be omitted.

Further, the cylinder apparatus of the present invention may be structured as an apparatus of a single-acting spring return type, instead of the double-acting type, which is exemplarily described. Pressurized fluid for driving used in the cylinder apparatus may be gas such as compressed air, instead of the exemplarily described pressurized oil.

Furthermore, the cylinder apparatus of the present invention is applicable to a technical field different from that of the clamps.

Moreover, it is a matter of course that other changes or alterations can be made on the present invention within the scope of envisagement of one skilled in the art.

The invention claimed is:

1. A cylinder apparatus including an annular piston (10) inserted into a housing (1) ascendably and descendably, an output rod (15) which is inserted into a cylindrical hole (10*a*) of the piston (10) and is inserted into an upper wall (2) of the housing (1), and a driving chamber (11) which is arranged above the piston (10) and where pressurized fluid for driving is supplied and discharged, the output rod (15) being configured to rotate in response to ascent and descent of the piston (10) relative to the output rod (15), the cylinder apparatus comprising:

a descent-detecting first detection valve (31) and an ascent-detecting second detection valve (32) which are arranged outside a periphery of the output rod (15) and in the upper wall (2), to be circumferentially spaced apart from each other at a predetermined interval;

a first operated portion (49) and a second operated portion (79) respectively provided on the first detection valve (31) and the second detection valve (32) in the vicinity of the driving chamber (11), the first operated portion (49) being arranged to be movable in response to movement of one of two members of the output rod (15) and the piston (10), the second operated portion (79) being arranged to be movable in response to movement of the other of the two members; and a first supply passage (B1) and a second supply passage (B2) through which pressurized air for detection is supplied to respective inlets (31*a*) (32*a*) of the first detection valve (31) and the second detection valve (32), respectively.

2. The cylinder apparatus according to claim 1, wherein:

the upper wall (2) is formed into a substantially rectangular or square shape in plan view, and a supply and discharge passage (21) which is communicatively connected to the driving chamber (11) is formed in one wall portion out of four wall portions respectively corresponding to four peripheral sides of the upper wall (2); and the first detection valve (31) and the second detection valve (32) are provided in any other wall portion than the wall portion where the supply and discharge passage (21) is formed out of the four wall portions.

3. The cylinder apparatus according to claim 2, wherein the upper wall (2) has a flange (7) for mounting, and a supply and discharge port (P1) communicatively connected to the supply and discharge passage (21) is opened onto a mounting surface (7*a*) formed on an under surface of an outer periphery portion of the flange (7).

4. The cylinder apparatus according to claim 3, wherein a first supply port (A1) and a second supply port (A2) communicatively connected to the first supply passage (B1) and the second supply passage (B2) respectively are opened, respectively below the first detection valve (31) and the second detection valve (32), onto the mounting surface (7*a*).

5. The cylinder apparatus according to claim 1, wherein:

the output rod (15) includes a first operating portion (23*a*), and the first operating portion (23*a*) is configured (i) to push the first operated portion (49) outward to open the first detection valve (31) when the output rod (15) moves from its lowered position to its upper limit position or to a position in the vicinity of the upper limit position, and (ii) to allow the first operated portion (49) to move inward to close the first detection valve (31) when the output rod (15) descends a predetermined first stroke (S1) from the upper limit position; and the piston (10) includes a second operating portion (10*b*), and the second operating portion (10*b*) is configured (i) to push the second operated portion (79) outward to close the second detection valve (32) when the piston (10) moves from its lowered position to its upper limit position or to a position in the vicinity of the upper limit position, and (ii) to allow the second operated portion (79) to move inward to open the second detection valve (32) when the piston (10) descends a predetermined second stroke (S2) from the upper limit position.

6. The cylinder apparatus according to claim 5, wherein:

a first transmission member (40) configured to convert ascent movement of the first operating portion (23*a*) to lateral movement is provided between the first operated portion (49) and the first operating portion (23*a*); and a second transmission member (70) configured to convert ascent movement of the second operating portion (10*b*) to lateral movement is provided between the second operated portion (79) and the second operating portion (10*b*).

7. The cylinder apparatus according to claim 6, wherein:

the first transmission member (40) and the second transmission member (70) each constituted by a ball are respectively inserted into a first transmission chamber (37) and a second transmission chamber (67) each of which is communicatively connected to an upper portion of the driving chamber (11); and stopper portions (37*a*) (67*a*) are provided to prevent the first transmission member (40) and the second transmission member (70) from falling down into the driving chamber (11) from the first transmission chamber (37) and the second transmission chamber (67), respectively.

8. A cylinder apparatus including a piston (10) inserted into a housing (1) ascendably and descendably, a driving chamber (11) which is arranged above the piston (10) and where pressurized fluid for driving is supplied and discharged, and an output rod (15) inserted into an upper wall (2) of the housing (1), the output rod (15) being configured to be descendingly driven, via the piston (10), by the pressurized fluid supplied to the driving chamber (11), the cylinder apparatus comprising:

a descent-detecting first detection valve (31) and an ascent-detecting second detection valve (32) which are arranged outside a periphery of the output rod (15) and in the upper wall (2), to be circumferentially spaced apart from each other at a predetermined interval;

a first operated portion (49) and a second operated portion (79) respectively provided on the first detection valve (31) and the second detection valve (32) in the vicinity of the driving chamber (11), the first operated portion (49) and the second operated portion (79) being arranged to be movable in response to movement of either one of the piston (10) and the output rod (15); and a first supply passage (B1) and a second supply passage (B2) through which pressurized air for detection is supplied to respective inlets (31*a*) (32*a*) of the first detection valve (31) and the second detection valve (32), respectively.

9. The cylinder apparatus according to claim 8, wherein:

one of the output rod (15) and the piston (10) includes a first operating portion (23*a*) and a second operating portion (10*b*);

the first operating portion (23*a*) is configured to allow the first detection valve (31) to be closed when the one of the output rod (15) and the piston (10) descends a predetermined distance from its upper limit position or from a position in the vicinity of the upper limit position; and the second operating portion (10*b*) is configured to close the second detection valve (32) via the second operated portion (79) when the one of the output rod (15) and the piston (10) ascends a predetermined distance from its lowered position.

10. The cylinder apparatus according to claim 9, wherein:

a first transmission member (40) configured to convert ascent movement of the first operating portion (23*a*) to lateral movement is provided between the first operated portion (49) and the first operating portion (23*a*); and a second transmission member (70) configured to convert ascent movement of the second operating portion (10*b*) to lateral movement is provided between the second operated portion (79) and the second operating portion (10*b*).

11. The cylinder apparatus according to claim 8, wherein:

the upper wall (2) is formed into a substantially rectangular or square shape in plan view, and a supply and discharge passage (21) which is communicatively connected to the driving chamber (11) is formed in one wall portion out of four wall portions respectively corresponding to four peripheral sides of the upper wall (2); and the first detection valve (31) and the second detection valve (32) are provided in any other wall portion than the wall portion where the supply and discharge passage (21) is formed out of the four wall portions.

12. The cylinder apparatus according to claim 8, wherein the first detection valve is constituted by a poppet valve while the second detection valve is constituted by a spool valve.

13. A cylinder apparatus including an annular piston (10) inserted into a housing (1) ascendably and descendably, an output rod (15) which is inserted into a cylindrical hole (10*a*) of the piston (10) and is inserted into an upper wall (2) of the housing (1), and a driving chamber (11) which is arranged above the piston (10) and where pressurized fluid for driving is supplied and discharged, the output rod (15) being configured to rotate in response to ascent and descent of the piston (10) relative to the output rod (15), the cylinder apparatus comprising:

an ascent-detecting detection valve (32) oriented laterally in an upper portion of the housing (1);

an operating portion (10*b*) provided on one of the piston (10) and the output rod (15);

an operated portion (79) provided on the detection valve (32) so as to be movable in response to movement of the operating portion (10*b*) in the vicinity of the driving chamber (11);

a transmission member (70) inserted into a transmission chamber (67) communicatively connected to an upper portion of the driving chamber (11), the transmission member (70) configured to convert ascent movement of the operating portion (10*b*) to lateral movement of the operated portion (79); and a supply passage (B2) through which pressurized air for detection is supplied to an inlet (32*a*) of the detection valve (32).

14. The cylinder apparatus according to claim 13, wherein a stopper portion (67*a*) is provided to prevent the transmission member (70) constituted by a ball from falling down from the transmission chamber (67) into the driving chamber (11).

* * * * *